US005460297A

United States Patent [19]

Shannon et al.

[11] Patent Number: 5,460,297

[45] Date of Patent: Oct. 24, 1995

[54] PAINT TINTING APPARATUS

[75] Inventors: Joseph W. Shannon; Thomas S. Green, both of Kent, Ohio

[73] Assignee: ABCC/Tech Corp., Akron, Ohio

[21] Appl. No.: 846,621

[22] Filed: Mar. 5, 1992

[51] Int. Cl.[6] ..... B67D 5/60

[52] U.S. Cl. ..... 222/135; 222/144.5

[58] Field of Search ..... 222/135, 145, 222/144.5, 424, 52; 422/100

[56] References Cited

U.S. PATENT DOCUMENTS

| | | | |
|---|---|---|---|
| 3,349,962 | 10/1967 | Levin | 222/144.5 X |
| 3,670,785 | 6/1972 | Heiss et al. . | |
| 3,814,285 | 6/1974 | Craig | 222/144.5 X |
| 4,019,652 | 4/1977 | Suh et al. | 222/135 X |
| 4,019,653 | 4/1977 | Scherer et al. | 222/144.5 X |
| 4,027,785 | 6/1977 | Edstrom et al. | 222/135 |
| 4,275,822 | 6/1981 | Juffa et al. | 222/135 X |
| 4,691,850 | 9/1987 | Kirschmann et al. | 222/144.5 X |
| 4,865,226 | 9/1989 | Becker et al. | 222/135 |
| 4,941,596 | 7/1990 | Marty et al. | 222/135 X |
| 5,148,945 | 9/1992 | Geatz | 222/135 X |
| 5,163,010 | 11/1992 | Klein et al. | 222/135 X |

*Primary Examiner*—Andres Kashnikow

*Attorney, Agent, or Firm*—Renner, Kenner, Greive, Bobak, Taylor & Weber

[57] ABSTRACT

A paint tinting system includes a plurality of colorant dispensing subsystems interconnected with a clear filler dispensing subsystem. Recipes maintained within a microprocessor control the dispensing of fixed volumes of colorant into dispensing tubes with such volumes being maintained between volumes of clear filler. Valve actuation introduces the colorant into a can of base paint, along with sufficient clear filler to assure a full measure of paint is generated. The subsystems provide for recirculation of the colorants and clear filler to assure that the same remain homogenous at the time dispensing is required.

24 Claims, 2 Drawing Sheets

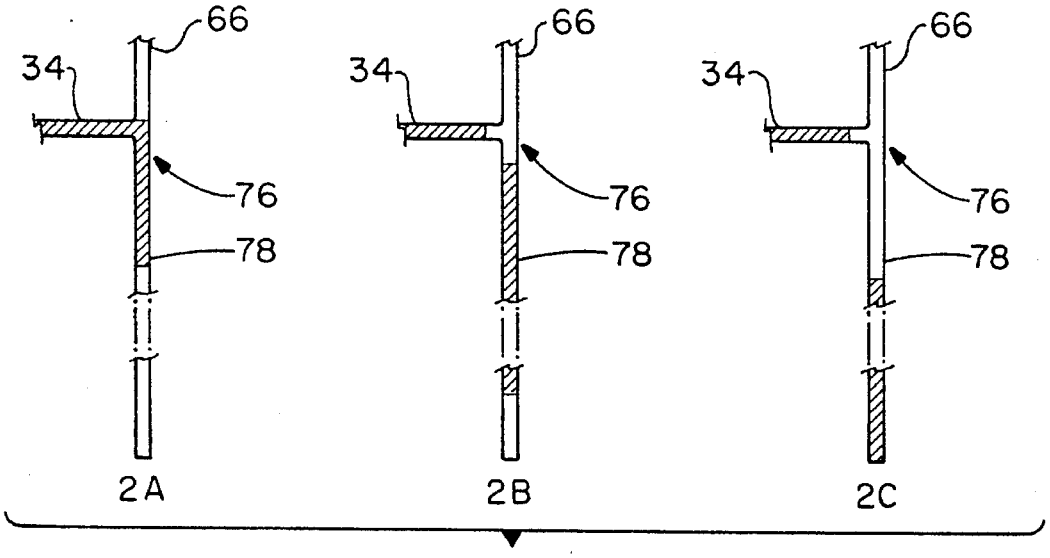
FIG.-2
FIG.-3
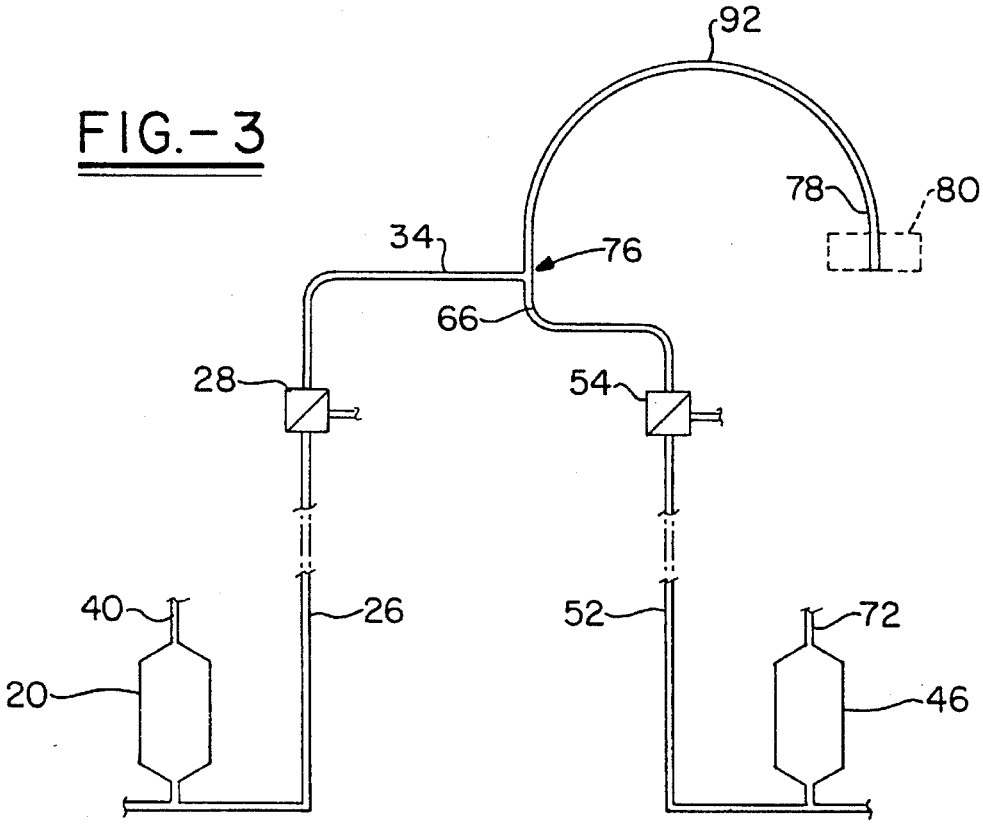

PAINT TINTING APPARATUS

TECHNICAL FIELD

The invention herein resides in the art of liquid dispensing systems and devices and, more particularly, to such a system or device for accurately dispensing small volumes of a particular type of a first liquid into a much larger volume of a second base liquid. Specifically, the invention relates to an apparatus and system for tinting or coloring paint by accurately adding preselected volumes of colorants to a larger volume of a base.

BACKGROUND ART

Paint is a widely used means for preserving, protecting, and decorating any of numerous articles and items encountered daily. Typically, the paint is provided with a tint or color to accentuate, highlight, or blend the painted article with respect to its surrounds. Since literally thousands of tints or shades of paint may be produced, stocking shelves of most retail establishments preclude the premixing or coloring of the paint before it is shelved. Retail efficiency dictates that only a limited number of preblended colors be stocked, and that the remainder of the colors or tints be produced on site. To this end, it has previously been known to employ paint tinting or coloring machines of a mechanical type, employing manually actuated displacement pumps for selecting and injecting various colorants into a can of paint base for ultimate mixing. Computer paint tinting systems have also been known. The same have typically employed motor gear positive displacement pumps for dispensing selected quantities of colorants.

The previously known tinting machines have required extensive maintenance to clean, purge, and repair the machines so that some degree of integrity in the dispensing operation could be maintained. Additionally, previously known systems have been limited in resolution, with the capability of dispensing 0.01 oz as the smallest volume that might be dispensed. Such limitations on the amount of colorant that may be dispensed limits the minimum volume of paint that may be colored or mixed and further limits the resolution of color shades which might be obtained. Because of these limitations, the prior art often requires mixing of a full gallon of a particular shade or color even though only a quart may be necessary for undertaking the desired painting project. The result has been the need to dispose of the remaining three quarts of the mixed paint, a waste of money and a threat to the environment.

Previously known computerized systems have also been of limited resolution and flexibility, generally constrained to the formulating of previously determined recipes. Even those systems employing spectrophotometers to determine the color of a known item have typically been employed simply to select the established recipe most closely replicating that color.

The previously known displacement pumps or displacement pistons have also been given to wear from the abrasive nature of the colorant employed. Such wear threatens the system integrity, resolution, and repeatability and, ultimately, requires repair. Additionally, such previously known systems have typically been given to operator errors and calibration problems, since the dispensing of the colorant has simply been achieved by the filling of a cavity of variable volume.

The prior art paint tinting systems have also required mechanical mixers to keep the pigment in the colorant in suspension so that the colorant is of uniform density and character when dispensed.

It has further been known from the prior art that the smallest volume of colorant that might be dispensed is the size of a "drop" of that colorant, the same varying in size as a function of the colorant of interest. For certain tints or colors, a "drop" may constitute a substantial volume of colorant, the presence or absence of which in the resulting mix may noticeably affect the resulting color. Additionally, if a "drop" of colorant is allowed to remain suspended from the dispensing tube of the paint tinting machine, it may either inadvertently drop into the next can of paint placed under the machine, or simply harden in the dispensing tube, requiring time consuming cleaning and purging.

DISCLOSURE OF INVENTION

In light of the foregoing, it is a first aspect of the invention to provide a paint tinting apparatus which will accommodate the coloring and mixing of a large number of shades of paint.

A further aspect of the invention is the provision of paint tinting apparatus which is given to high resolution and repeatability.

Still a further aspect of the invention is the provision of a paint tinting apparatus which is capable of coloring and blending colors in small volumes of paint, obviating the need for mixing large volumes of paint to undertake small jobs.

Yet a further aspect of the invention is the provision of a paint tinting apparatus which provides a means for recirculating the colorant to maintain the same with a homogenous nature.

Yet an additional aspect of the invention is the provision of paint tinting apparatus which is not given to the wear experienced in the prior art.

Another aspect of the invention is the provision of a paint tinting apparatus having an accuracy in dispensing which is independent of the size of a "drop" of colorant.

Still a further aspect of the invention is the provision of a paint tinting apparatus in which no drops are left at the output of the dispensing tube.

An additional aspect of the invention is the provision of a paint tinting apparatus which is reliable and durable in operation, cost effective, and conducive to implementation with state of the art techniques and devices.

The foregoing and other aspects of the invention which will become apparent as the detailed description proceeds are achieved by a liquid dispensing apparatus, comprising: first dispensing means for dispensing a first liquid; second dispensing means for dispensing a second liquid; and control means interconnecting said first and second dispensing means for regulating quantities of said first and second liquids dispensed and a sequence of such dispensing by said first and second dispensing means.

Other aspects of the invention are attained by the liquid dispensing apparatus as aforesaid, wherein said first and second dispensing means are connected to a common dispensing conduit from which said first and second liquids are dispensed.

Yet additional aspects of the invention are attained by the liquid dispensing apparatus as first mentioned, wherein said first dispensing means comprises a reservoir of said first liquid and a pump interconnected with said reservoir, said control means being operative to recirculate said first liquid from said reservoir, through said pump, and returned to said reservoir, and to further dispense said first liquid.

Yet additional aspects of the invention which will become apparent herein are attained by the liquid dispensing apparatus as first mentioned, wherein said first and second dispensing means have respective first and second output conduits, said first and second output conduits being interconnected and forming a dispensing conduit.

Additional aspects of the invention are attained by the liquid dispensing apparatus as first mentioned, wherein said control means determines a rate of flow of said liquids from said respective dispensing means.

Still other aspects of the invention are attained by the liquid dispensing apparatus as first mentioned, wherein said control means prevents dripping and intermixing of said first and second liquids.

DESCRIPTION OF DRAWINGS

For a complete understanding of the objects, techniques, and structure of the invention, reference should be made to the following detailed description and accompanying drawings wherein:

FIG. 2 is a detailed illustration of the interconnection of output conduits and a dispensing conduit according to the invention, and wherein FIG. 2A shows the colorant being ejected from a first output conduit into the dispensing conduit, FIG. 2B shown a clear composition being ejected from a second output conduit into the first output conduit and the dispensing conduit; and FIG. 2C shows the dispensing of the colorant from the dispensing conduit; and FIG. 3 is an illustrative schematic showing the positional relationship of the pumps, pour head, and dispensing conduit of the apparatus of the invention.

BEST MODE FOR CARRYING OUT THE INVENTION

Figure 1:
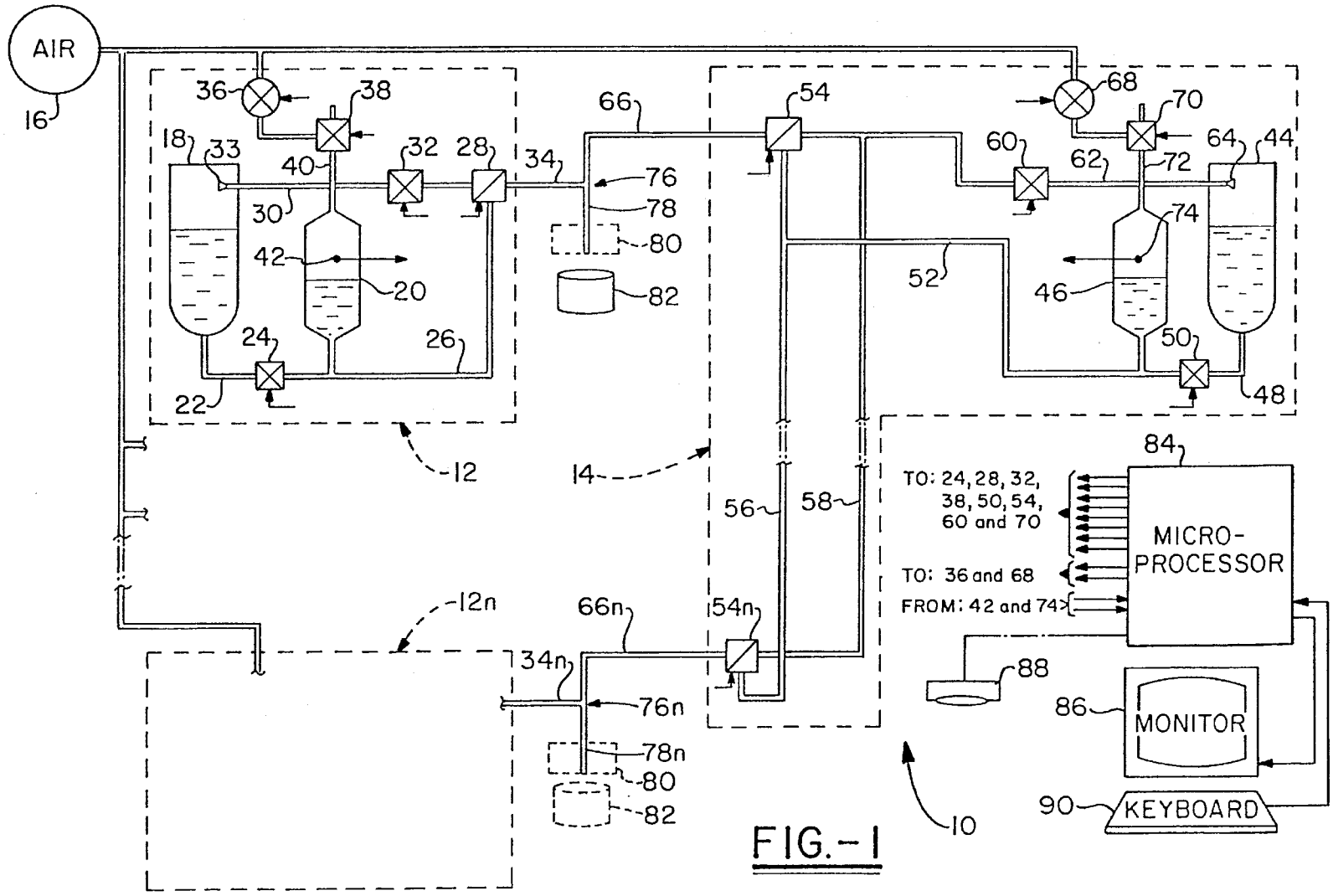
FIG. 1 is a schematic diagram of the paint tinting apparatus of the invention.

Referring now to the drawings and more particularly FIG. 1, it can be seen that a paint tinting system according to the invention is designated generally by the numeral 10. The system 10 includes a plurality of tint or colorant dispensing systems 12–12*n*. It will be appreciated that each of the subsystems 12 is identical, differing only with respect to the particular tint or colorant to be dispensed thereby. Typically, the system 10 would include 8–15 such colorant dispensing subsystems 12, although the concept of the invention extends to any such number.

Also included as a part of the system 10 is a clear filler dispensing subsystem 14. In the preferred embodiment of the invention, only one such subsystem 14 is employed in the invention, the same communicating with each of the colorant subsystems 12–12*n* in a manner which will become apparent below.

It will be appreciated that the paint tinting system 10 is a pneumatic system, operating off of an air pressure source 16 which communicates with each of the plurality of colorant dispensing subsystems 12–12*n* and the clear filler dispensing subsystem 14 to provide the driving force to achieve such dispensing.

With continued reference to FIG. 1, consideration will now be given to the structure of each of the colorant dispensing subsystems 12. As shown, each subsystem 12 includes a reservoir 18 for receiving a bulk supply of liquid colorant. The reservoir 18 will typically be vented to atmosphere, to allow ready ingress and egress of colorant thereto. A pneumatic pump 20, as is presently well known and understood by those skilled in the dispensing art, is provided in communication with the reservoir 18 through a conduit 22 in which a solenoid valve 24 is interposed. It will be appreciated that actuation of the valve 24 allows the colorant to pass from the reservoir 18 to the pump 20. A conduit 26 passes from the pump 20 to a dispensing valve 28. In the preferred embodiment of the invention, the dispensing valve 28 is of the paddle type, and allows for the passage of fluid through two different outlets, a first of which is always open, and a second of which is selectively valved. With the valve 32 open and the valve 28 dosed, fluid from the pump 20 passes through the conduit 26, valves 28, 32, and conduit 30 and into the reservoir 18. With the valves 28, 32 both open, a first portion of the fluid recirculates as just described, while a second portion passes through the valve 28 and into the output conduit 34. The percentage of split of the fluid to the conduits 30, 34 at the valve 28 may be mechanically set and is a known factor. This feature allows dispensing and recirculating to proceed concurrently. Finally, with the valve 32 closed and the valve 28 open, all of the fluid from the pump 20 passes through the conduits 26, 34, at a flow rate determined by the pressure head within the pump 20 and the restrictions of the conduits and valve. This latter described operation may be employed when large volumes are to be dispensed, such as when the system 10 or subsystem 12 is purged.

As shown, the conduit 30 passes into a top portion of the reservoir 18 and terminates in a spray nozzle 33. Accordingly, colorant from the pump 20 passing through the conduit 26, valve 28, valve 32, and conduit 30 reenters the reservoir 18 through the spray nozzle 33. The trajectory of the colorant as emitted from the nozzle 33 is, of course, dependent upon the pressure head under which it is dispensed from the pump 20 as will be discussed below.

Also included in each of the colorant dispensing subsystems 12 is a pressure regulator 36 communicating with the pressure source 16. Pressure regulator 36 passes air at a selectable pressure to a 3-way valve 38 which is interposed in the conduit 40 having a fixed restriction of known orifice diameter therein. Actuation of the 3-way valve 38 allows air pressure from the source 16 to communicate through the pressure regulator 36 into the pump 20 in one state of actuation. In another state, the valve 38 allows the pump 20 to be vented to atmosphere. It will be appreciated by those skilled in the art that a pressure head is introduced into the pump 20 when dispensing or recirculating of colorant is desired, and the pump 20 will be vented to atmosphere when it is desired to refill the pump 20 with colorant from the reservoir 18.

Also provided within the pump 20 is a pressure transducer 42 which serves to monitor the pressure head within the pump 20 in a manner to be described below. Suffice it to say now that the time required for the pressure head within the pump 20 to build from atmosphere to the level of the regulator 36 through the fixed orifice of the conduit 40 is an indication of the volume of colorant within the pump 20 and, accordingly, is an indication as to whether additional colorant need be passed from the reservoir 18 into the pump 20.

Having considered the structure of each of the colorant dispensing subsystems 12–12*n*, attention is now directed to the clear filler dispensing subsystem 14. The similarities between the subsystem 14 and each of the subsystems 12 should be readily apparent. As shown, a reservoir 44 is provided for receipt and maintenance of a bulk supply of the clear filler. A pneumatic pump 46 communicates with the reservoir 44 through a conduit 48, with a solenoid control 50 interposed therebetween. An output conduit 52 communicates with a plurality of dispensing valves **54–54*n* through an interconnecting conduit 56, as shown. The dispensing valves 54–54*n* are of the paddle type, similar to the valves 28, allowing for recirculating and/or dispensing of clear filler. Recirculating of the filler is through the conduit 58, through the solenoid valve 60, through the conduit 62, and out of the spray nozzle 64 maintained within a top portion of the reservoir 44. Dispensing of the clear filler is achieved through an associated dispensing valve 54–54*n* and through the output conduits 66–66*n* as shown. It will be appreciated that a dispensing valve 54 and associated output conduit 66 is associated with each of the colorant dispensing subsystems 12–12*n*** as shown.

A pressure regulator 68 is interconnected with the pressure source 16 and communicates with the 3-way valve 70 which is operative through the conduit 72 to expose the interior of the pump 46 to atmosphere or to a pressure head induced through the regulator 68. Again, it will be appreciated that the conduit 72 has a fixed restriction of known orifice diameter therein such that the rate of pressure change within the pump 46 as sensed by the pressure transducer 74 can be used to determine the volume of clear filler within the pump 46.

As shown in FIG. 1, the output conduit 34 mates with the output conduit 66 at a Tee connection 76. In like manner, output conduit **34*n* mates with output conduit 66*n* at the Tee connection 76*n*. The output of the respective Tee connections is the dispensing conduit 78–78*n*. It will, of course, be appreciated that an output 34 of each of the colorant dispensing subassemblies 12 is connected to a respectively associated output conduit 66. The dispensing tubes for conduits 78–78*n* are grouped together and maintained within a dispensing head 80. In a preferred embodiment of the invention, 8–15 such dispensing conduits 78 would be present within the head 80. A paint can or other appropriate receptacle 82, being of a quart, gallon, or five gallon size, is positioned under the dispensing head 80** to receive the colorant and clear filler in a manner to be discussed below.

With continued reference to FIG. 1, it can be seen that the control unit of the paint tinting system 10 comprises a microprocessor 84 which is operative to control the various valves 24, 28, 32, 38, 50, 54, 60, and 70. Additionally, the microprocessor 84 controls the pressure regulators 36, 68 and receives data from the pressure transducers 42, 74 indicative of the instantaneous pressure head within the associated pumps 20, 46. It will also be appreciated that the microprocessor 84 contains recipes for the various colors, tints, and shades of paint which can be produced by the system 10. Such recipes are tailored to the volume of paint to be mixed, and identify the amount of colorants from each of the colorant dispensing subassemblies **12–12*n* which is to be dispensed into the paint can 82 and the amount of clear filler to be dispensed therein from the subsystem 14**.

A video monitor 86 is provided in communication with the microprocessor 84 for visual communication therewith. Additionally, a digital spectrophotometer 88 is interconnected with the microprocessor 84. Those skilled in the art will understand that the spectrophotometer 88 may be used to view an item of a desired color and to digitally analyze that color to develop a recipe through the microprocessor 84 for replicating that color of paint through the system 10. In other words, the microprocessor 84 would determine the amounts of colorants from each of the subsystems **12–12*n* and clear filler from the subsystem 14 to be added to a can of base paint 82 to achieve the color of the item analyzed by the spectrophotometer 88**.

Finally, a keyboard 90 is also provided in communication with the microprocessor 84 to provide for operator input and communication therewith.

With an appreciation of the structure of the invention, consideration may now be given to the operation of the same. In the quiescent state, each of the subsystems 12, 14 is caused to periodically recirculate the fluid thereof to assure the maintenance of a homogenous mix. With respect to the colorants, particularly, it is desired that the pigment thereof not settle out of the colorant, but be maintained in suspension therein. Accordingly, the valve 38 may be actuated by the microprocessor 84 to cause the pressure source 16 to communicate with the pump 20 through the regulator 36. Before such actuation of the 3-way valve 38, the pump 20 is vented to atmosphere through the valve 38 and, accordingly, the interior of the pump 20 is at atmospheric pressure. With the input conduit 40 having a fixed diameter orifice therein, the amount of time required for the interior of the pump 20 to rise to the pressure presented by the regulator 36 is indicative of the volume of colorant within the pump 20. Accordingly, the microprocessor 84 may correlate time with volume and call for the refilling of the pump 20 as required and in a manner to be discussed below. With a pressure head upon the pump 20, the valve 32 is opened so that colorant passes through the conduit 26 and conduit 30 and out of the spray nozzle 33 maintained within the top of the reservoir 18. During the spraying operation, the pressure head within the pump 20 may be varied by the regulator 36 under control of the microprocessor 84 such that the trajectory of the colorant from the spray nozzle 33 may be varied, assuring desired agitation and mix of the colorant. Of course, the pressure head may be altered by the regulator 36 during the actual recycling process, or it may be adjusted before the recycling process and maintained consistently during recycling.

In the event that the pressure transducer 42 signals that the volume of colorant within the pump 20 is low, the valve 38 may be actuated to vent the pump 20 to atmosphere and the valve 24 may be opened to allow colorant from the reservoir 18 to pass into the pump 20 for a period of time sufficient to refill the same. With the reservoir 18 maintained above the pump 20, such refilling can be accomplished by gravity feed. Of course, a pressure head may be introduced to the pump 18 for the refilling operation if desired.

During the refilling and recirculating processes just described, the flow rates of the colorants and clear filler may be readily determined so that selected volumes of the same may be accurately dispensed. Consider representatively the colorant dispensing subsystem 12. The pump 20 is initially vented to atmosphere through the valve 38. The valve 38 then switched to interconnect the pump 20 with the pressure source 16 through the pressure regulator 36. Air passes under a fixed and regulated pressure head through the fixed orifice of the conduit 40 and into the chamber of the pump 20 until the chamber reaches the pressure set by the regulator 36. The pressure transducer 42 is monitored by the microprocessor 84 which determines the elapsed time required to raise the pressure within the pump chamber from atmosphere to the set pressure head, such time establishing the volume of the pressure head and, accordingly, the volume of colorant within the pump. When the valve 32 is opened, the constant regulated pressure head within the pump 20 urges colorant through the conduit 26, valve 28, valve 32, conduit 30 and into the reservoir 18. Such recirculating is maintained for a set period of time, then terminated. The valve 38 then vents the pump 20 to atmosphere, then switches again to interconnect the pump chamber 20 with the pressure source 16 through the regulator 36. The time required to return the pump chamber to the fixed pressure head through the restricted orifice of the conduit 40 is again indicative of the volume of colorant remaining in the pump 20. Hence, the microprocessor 84 may readily determine the volume of colorant dispensed from the pump 20 during the recirculating process of fixed duration and, accordingly, may also determine the flow rate of colorant at that point in time. The flow rate is repeatedly determined and the latest determination is employed by the microprocessor 84 when a dispensing cycle is engaged.

Those skilled in the art will also appreciate that the volume changes and flow rate determination just described may be made in various manners. For example, after the pump 20 is pressurized to a set head, and the determinations of initial volume made, the valve 38 may be closed to seal the pump 20 and the recirculating valve 32 may be opened to allow colorant to pass from the pump 20 into the reservoir 18. The rate of decay of the pressure head monitored by the transducer 42 is determinative of the flow rate of the colorant and may be employed by the microprocessor 84 on the next dispensing cycle.

Refilling and recirculating of the pump 20 on a periodic basis assures that the colorant within the reservoir 18 is maintained in a mixed state, with the pigment thereof properly suspended. When a dispensing operation is desired, the valve 28 is opened so that colorant may pass through the valve 28 and into the output conduit 34 for passage into the dispensing tube or conduit 78. The specific operation of this technique is best understood with reference to FIG. 2. In the illustration of FIG. 2, colorant is designated by a lined pattern, while the unlined portions of the conduits 34, 66, 78 indicate the presence of clear filler therein. Before any dispensing operation is commenced, it will be appreciated that clear filler is present within the output conduit 66 and the dispensing conduit 78. A small finite known quantity of filler is also present at the end of the output conduit 34 for reasons which will become apparent immediately below. With the pump 20 having a known fixed pressure head thereon, when the valve 28 is opened for a fixed period of time a corresponding known quantity of colorant is dispensed from the pump 20, through the conduit 26, valve 28, output conduit 34, and into the dispensing conduit 78. This action causes a volume of dear filler to be dispensed from the dispensing conduit 78 of a volume equal to the volume of colorant introduced into the dispensing conduit 78. This is the volume of colorant required by the recipe selected via the keyboard 90 or spectrophotometer 88 through the microprocessor 84. Such a quantity of colorant is shown in the dispensing tube 78 in the illustration of FIG. 2A.

After closure of the valve 28, establishing the desired quantity of colorant within the dispensing tube 78, the valve 38 is actuated to vent the pump 20 to atmosphere. The valve 28 is then opened and the valve 54 is actuated for a controlled short period of time such that clear filler is emitted from the pressurized pump 46, through the conduit 52, valve 54, and into the output conduit 66. With the pump 20 vented to the atmosphere, the clear filler from the conduit 26 passes equally into the conduit 34 and dispensing conduit 78 as shown in FIG. 2B. Accordingly, there is a buffer of clear filler in the conduit 34 between the colorant maintained therein and the flow path of clear filler from the output conduit 66 and dispensing conduit 78 as shown in FIG. 2B. This buffer prevents a Venturi effect which might result in the drawing of colorant from the output conduit 34 and into the dispensing tube 78 when the colorant is dispensed as discussed below.

It will be appreciated that various colorant dispensing subsystems **12–12*n* will have been "loaded" as discussed above and in accordance with the recipe selected. With the paint can 82 beneath the dispensing head 80, the pressurized pump 46 is activated and associated valves 54, 54*n* are energized such that the clear filler from the pump 46 is passed through the selected output conduits 66–66*n* to dispense the appropriate volumes of colorants from the dispensing tubes 78–78*n* into the paint can 82. Of course, all of the valves 28 of the associated colorant dispensing subsystems 12 are closed during this operation so that no backwash of clear filler into the conduits 34 is experienced. Accordingly, fixed measures of colorant are dispensed into the can 82** in accordance with the selected recipe.

Those skilled in the art understand that the base paint maintained within the can 82 is generally devoid of a full measure by a set amount. To assure that a full quantity of paint is provided such that the colored mix is appropriate, sufficient clear filler is dispensed through the selected output conduits **66–66*n* and associated dispensing conduits 78–78*n*** to supplement the aggregate volume of colorants to guarantee a full measure of paint is generated.

After the dispensing discussed above, a lid is placed and sealed upon the can 82 and the same is placed in the "shaker" for blending.

It should be appreciated that the recycling and dispensing of clear filler from the subsystem 14 is substantially identical to the dispensing of the colorant from the subsystems **12–12*n* as just described. The clear filler is used as the driving force for dispensing selected volumes of colorant which have been introduced into associated dispensing tubes 78–78*n* by pressure and time dependent dispensing through the associated valves 32. Accordingly, at the end of each dispensing cycle only clear filler remains in each of the dispensing tubes 78–78*n*, precluding any likelihood of colorant accidentally entering a paint can 82 placed beneath the dispensing head. Since the clear filler is not given to solidification and hardening upon exposure to the air, clogging of the dispensing tubes is substantially eliminated. Additionally, the colorant is sealed from atmosphere in the output conduit 34 and is otherwise repeatedly recirculated between the pump 20 and reservoir 18** as discussed above.

As shown in FIG. 3, the pumps 20, 46 are preferably maintained below the dispensing head 80. Accordingly, when the pumps 20, 46 are vented to atmosphere by their valves 38, 70, the fluids in the dispensing conduit 78 may be withdrawn from the dispensing head 80, precluding the likelihood of any unwanted drops or disbursements. In the preferred embodiment, following termination of a dispensing cycle, the pump 20 is vented to atmosphere and the valve 28 opened for a short time period to allow a portion of the clear filler in the line 78 to draw into the output conduit 34 at the T-connection 76 to assure a substantial known and fixed buffer of clear filler between the colorant in the remainder of the line 34 and the dispensing conduit 76. In like manner, the pump 46 is vented to atmosphere and the valve 54 opened for a short fixed duration of time sufficient to allow the clear filler in the dispensing conduit 78 to withdraw from the pour head 80 and past the apex 92 in the conduit 78. Accordingly, all fluid is maintained on a side of the apex of the dispensing conduit 78 which is opposite the side on which the dispensing head 80 is located. Accordingly, no inadvertent drips may occur.

It is also presented as a part of the invention that the resultant color from a selected recipe may be illustrated upon the video monitor 86 in actual color. Further, various formulas may be generated by the operator through the keyboard 90 with the resultant color shown on the monitor 86. Accordingly, an operator may construct or devise a recipe or modify an existing recipe and actually view the resultant color as various modifications are made.

As also presented above, the spectrophotometer 88 may be employed to view an actual color sample and generate the recipe of various colorants to replicate the subject color.

It should now be appreciated by those skilled in the art that the paint tinting system 10 allows for extremely accurate measuring and dispensing of colorant liquids, which are independent of "drop" size of the colorant and which system is not given to wear, resolution, repeatability, or accuracy problems. Additionally, with the recipes provided under control of the microprocessor 84, operator error is substantially eliminated.

Thus it can be seen that the objects of the invention has been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. Liquid dispensing apparatus, comprising:

first dispensing means for dispensing a first liquid;

second dispensing means for dispensing a second liquid, said first and second dispensing means being connected to a common dispensing conduit from which said first and second liquids are dispensed; and control means interconnecting said first and second dispensing means for regulating quantities of said first and second liquids dispensed and a sequence of such dispensing by said first and second dispensing means, said control means regulating mutually exclusive dispensing of said first and second liquids from said dispensing conduit, introducing a first measured quantity of said first liquid into said dispensing conduit and maintaining said first measured quantity of said first liquid in said dispensing conduit between quantities of said second liquid.

2. The liquid dispensing apparatus according to claim 1, further comprising first and second output conduits respectively connected to said first and second dispensing means and interconnecting with said dispensing conduit.

3. The liquid dispensing apparatus according to claim 1, wherein said first and second dispensing means have respective first and second output conduits, said first and second output conduits being interconnected and forming a dispensing conduit.

4. The liquid dispensing apparatus according to claim 3, wherein said control means causes said first dispensing means to inject a first quantity of said first liquid into said dispensing conduit, and subsequently causes said second dispensing means to inject a second quantity of said second liquid into said first output conduit.

5. The liquid dispensing apparatus according to claim 4, wherein said control means subsequently actuates said second dispensing means to urge said first quantity of said first liquid from said dispensing conduit along with a third quantity of said second liquid.

6. Liquid dispensing apparatus, comprising:

first dispensing means for dispensing a first liquid;

second dispensing means for dispensing a second liquid;

control means interconnecting said first and second dispensing means for regulating quantities of said first and second liquids dispensed and a sequence of such dispensing by said first and second dispensing means; and wherein said first dispensing means comprises a reservoir of said first liquid and a pump interconnected with said reservoir, said control means being operative to recirculate said first liquid from said reservoir, through said pump, and return it to said reservoir through a nozzle, regulate a trajectory of said first liquid from said nozzle into said reservoir, and to further dispense said first liquid.

7. The liquid dispensing apparatus according to claim 6, wherein said first dispensing means comprises a dispensing valve interconnected with said control means for selectively recirculating said first liquid and dispensing said first liquid.

8. The liquid dispensing apparatus according to claim 6, wherein said pump comprises a pneumatic pump connected to a source of pressure, said source of pressure being connected to and regulated by said control means.

9. The liquid dispensing apparatus according to claim 8, wherein said control means monitors pressure in said pump and determines a volume of said first liquid in said pump as a function of said pressure.

10. Liquid dispensing apparatus, comprising:

first dispensing means for dispensing a first liquid;

second dispensing means for dispensing a second liquid;

control means interconnecting said first and second dispensing means for regulating quantities of said first and second liquids dispensed and a sequence of such dispensing by said first and second dispensing means; and wherein said first dispensing means comprises a reservoir of said first liquid and a pneumatic pump interconnected with said reservoir and a source of pressure, said source of pressure being connected to and regulated by said control means, said control means monitoring pressure in said pump and determining a volume of said first liquid in said pump as a function of said pressure.

11. The liquid dispensing apparatus according to claim 10, wherein said control means monitors a change in volume of said first liquid in said pump over a course of time and determines a flow rate of said first liquid from said pump as a function thereof.

12. The liquid dispensing apparatus according to claim 10, wherein said control means monitors a change in pressure in said pump over a course of time and determines a flow rate of said first liquid from said pump as a function thereof.

13. The liquid dispensing apparatus according to claim 10, wherein said control means monitors a change in volume of said first liquid in said pump over a course of time and determines a flow rate of said first liquid from said pump as a function thereof.

14. The liquid dispensing apparatus according to claim 10, wherein said control means monitors a change in pressure in said pump over a course of time and determines a flow rate of said first liquid from said pump as a function thereof.

15. Liquid dispensing apparatus, comprising:

first dispensing means for dispensing a first liquid;

second dispensing means for dispensing a second liquid;

control means interconnecting said first and second dispensing means for regulating quantities of said first and second liquids dispensed and a sequence of such dispensing by said first and second dispensing means; and wherein said first and second dispensing means have respective first and second output conduits, said first and second output conduits being interconnected and forming a dispensing conduit, said control means causes said first dispensing means to inject a first quantity of said first liquid into said dispensing conduit, and subsequently causes said second dispensing means to inject a second quantity of said second liquid into said first output conduit, and subsequently actuates said second dispensing means to urge said first quantity of said first liquid from said dispensing conduit along with a third quantity of said second liquid, said first, second, and third quantities being fixed quantities according to a paint recipe.

16. The liquid dispensing apparatus according to claim 15, wherein said first, second, and third quantities are fixed quantities according to a paint recipe.

17. The liquid dispensing apparatus according to claim 16, wherein said first liquid comprises a colorant for paint tinting, and said second liquid comprises a clear filler.

18. The liquid dispensing apparatus according to claim 17, further comprising a plurality of dispensing means, said colorant of each of said plurality of first dispensing means being of a different tint.

19. The liquid dispensing apparatus according claim 18, wherein said second dispensing means is connected to each of said plurality of first dispensing means.

20. The liquid dispensing apparatus according to claim 19, wherein said control means comprises a digital processor.

21. The liquid dispensing apparatus according to claim 20, further comprising a spectrophotometer interconnected with said control means, said spectrophotometer optically analyzing colored elements and said control means determining a colorant recipe for actuating selected ones of said plurality of first dispensing means to attain paint colors corresponding to said colored elements.

22. The liquid dispensing apparatus according to claim 21, further comprising a video monitor and an operator actuatable keyboard connected to said control means, said keyboard providing means for selecting specific quantities of selected ones of said colorants for addition to a paint base, and said monitor displaying a colored indicia of the resulting paint if such addition were made.

23. Liquid dispensing apparatus, comprising:

first dispensing means for dispensing a first liquid;

second dispensing means for dispensing a second liquid;

control means interconnecting said first and second dispensing means for regulating quantities of said first and second liquids dispensed and a sequence of such dispensing by said first and second dispensing means; and wherein said first and second dispensing means have respective first and second output conduits, said first and second output conduits being interconnected and forming a dispensing conduit, said control means causing said first and second dispensing means to respectively inject said first and second liquids into said first and second output conduits and subsequently deactivating said first and second dispensing means, causing said first and second liquids to retract in respective ones of said first and second output conduits toward respectively associated ones of said dispensing means.

24. The liquid dispensing apparatus according to claim 23, wherein said deactivation of said first and second dispensing means further retracts said second liquid from a dispensing end of said dispensing conduit.

* * * * *